United States Patent [19]

Newton

[11] 4,301,614

[45] Nov. 24, 1981

[54] TOY AIRPLANE AND METHOD FOR MAKING SAME

[76] Inventor: Wood A. Newton, 1013 Maplehurst, Nashville, Tenn. 37204

[21] Appl. No.: 105,087

[22] Filed: Dec. 19, 1979

[51] Int. Cl.[3] ..... A63H 27/00; A63H 33/00

[52] U.S. Cl. ..... 46/79; 46/11

[58] Field of Search ..... 46/1 L, 11, 79, 80, 46/81; 244/153 R; D21/87, 88, 89, 90; 229/44 R, 1.5 R, 8, 1.5 B

[56] References Cited

U.S. PATENT DOCUMENTS

| | | | |
|---|---|---|---|
| D. 162,790 | 4/1951 | Christman | 46/79 |
| 2,168,653 | 8/1939 | Meagher, Jr. | 46/79 |
| 2,251,090 | 7/1941 | West | 46/79 |
| 2,644,271 | 7/1953 | Shapiro | 46/81 |
| 2,896,370 | 7/1959 | De Witt, Jr. | 46/79 |
| 3,576,086 | 4/1971 | Halsey | 46/79 |
| 3,680,253 | 8/1972 | Spencer | 46/79 |
| 3,729,862 | 5/1973 | Halsey | 46/79 |
| 3,733,737 | 5/1973 | Goodman | 46/79 |
| 3,946,519 | 3/1976 | Vadik et al. | 46/79 |
| 4,122,626 | 10/1978 | Waters | 46/79 |
| 4,183,446 | 1/1980 | Davis | 229/44 R |

*Primary Examiner*—Robert Peshock
*Assistant Examiner*—Michael J. Foycik
*Attorney, Agent, or Firm*—Andrew S. Neely

[57] ABSTRACT

A toy airplane is constructed from a straw and wing components taken from a food container. The main wing is formed from the container and mounted on the forward end of the straw. A V-shaped midregion is formed in the main wing with a living hinge forming the bottom of the V-shaped midregion. A brace is inserted through slits at the top of the V-shaped midregion to form a triangular wing structure that resists deformation during loading on the wing. A rudder and an elevator wing are formed from the container and mounted on the rear end of the straw, and a weight is mounted in the forward end of the straw to complete the construction of the airplane.

33 Claims, 8 Drawing Figures

TOY AIRPLANE AND METHOD FOR MAKING SAME

FIELD OF INVENTION

The present invention relates to toy glider airplanes, and particularly relates to a toy glider airplane made from a container and a method for making the same from a straw and a rigid cellular polystyrene container (a styrofoam container) such as a hamburger container commonly found in fast-food restaurants.

BACKGROUND OF INVENTION

Toy glider airplanes have been constructed in accordance with many different designs from numerous materials including balsa wood, paper, styrofoam and plastic. It is known that toy glider airplanes may be constructed from one or more sheets of styrofoam (rigid, lightweight cellular polystyrene). However, conventional toy airplanes are generally complicated in design and construction so that such airplanes are difficult or cumbersome to construct. Particularly, children find airplanes of known designs difficult to make.

Furthermore, known airplane designs are not adapted to be constructed from styrofoam containers such as hamburger containers commonly used in fast food restaurants. Known methods of constructing toy airplanes do not include a method for constructing a toy airplane from a container and a straw. And, known containers such as styrofoam hamburger containers do not include tear lines for facilitating the construction of a toy airplane from the container.

SUMMARY OF THE INVENTION

In the present invention, a toy airplane is constructed from a container, and in a particular embodiment, a toy airplane is constructed from a styrofoam hamburger container and a straw. This particular toy airplane uses the V-shape and the curved contours of the hamburger container to form a stable and efficient gliding airplane. Although the airplane of the present invention is a stable and efficient glider, it is simple to construct so that even children will have little or no difficulty in constructing it.

In accordance with another aspect of the present invention, a method is disclosed for constructing an airplane from a straw and a container in which tear lines are formed on the container in the shape of wing structures for use in constructing the toy airplane. The container is weakened along the tear lines, and the wings are removed from the container by tearing action along the tear lines. The wings are then mounted on the straw which functions as a fuselage for the toy airplane.

In accordance with a particular aspect of the invention, a toy glider airplane for being constructed at least partially from a container formed of generally planar material includes a drinking straw having a forward and a rearward end. A plurality of wing structures are constructed from the generally planar material of the container, and at least one of the wing structures is mounted on a forward end of the straw to form a forward main wing of the toy airplane for providing lift during flight. At least one of the wing structures is mounted on the rearward end of the straw for controlling the orientation of the toy airplane during flight.

In accordance with another aspect of the present invention, a toy glider airplane for being constructed from a container formed of generally planar material includes a wing constructed of the generally planar material of the container and has a V-shaped midregion with two wing portions extending outwardly from the outer edges of the V-shaped midregion. The center of the V-shaped midregion of the wing is attached to the forward end of a substantially rigid fuselage. A planar brace member is attached to the wing and extends across the top of the V-shaped midregion to form a triangular load bearing wing structure. The brace member is operable to reinforce the V-shaped midregion of the wing to prevent deformation thereof under loading on the wing portions before and during flight of the airplane. Flight control wings constructed of the generally planar material are mounted adjacent to the rearward end of the fuselage for controlling orientation of the airplane during flight.

In accordance with a method of the present invention for constructing a toy airplane from a fuselage and a container made of generally planar material, a tear line is formed in the container with the tear line outlining the shape of at least one wing structure on the container. The container is torn along the tear line and at least one wing structure is removed from the container. This wing structure is attached to the fuselage to construct a toy airplane.

In accordance with another aspect of the present invention, a container for containing food and the like and for use in contructing a toy airplane includes at least one compartment constructed of a generally planar material. Structure is provided for closing the compartment to isolate and contain food and the like within the compartment. A tear line is formed in the container in the shape of at least one wing, and the compartment is weakened along the tear line to facilitate tearing the wing from the compartment.

In accordance with another aspect of the present invention, a container has an upper compartment constructed of generally planar material with an open bottom, a closed flat top, and four generally upright sides inclined inwardly from the open botton to the flat top so that the upper compartment has a truncated quadrangular pyramid shape. The upper compartment has rounded corners at the intersections of the upright sides and the top thereof, and has rounded edges at the intersections of the generally upright sides thereof. The container further has a lower compartment constructed of generally planar material with an open top, a closed flat bottom and four generally upright sides inclined upwardly from the open top to the closed flat bottom so that the lower compartment has a truncated quadrangular pyramid shape. The open top of the lower compartment is constructed to mate with the open bottom of the upper compartment to form a closed container. The lower compartment has rounded corners at the intersections of the sides and the bottom thereof and has rounded edges at the intersections of the upright sides thereof. The container further has a living hinge formed between the lower edge of an upright side of the upper compartment and the upper edge of an upright side of the lower compartment so that the compartments are rotatable between a closed position in which the upper compartment is disposed above the lower compartment to form a closed container and an open position in which the upper and lower compartments are disposed in a side-by-side relationship.

In accordance with an improvement of the container, a wing tear line extends along the upper and lower compartments outlining a wing for a toy airplane on the container. The wing is positioned on the container with the living hinge disposed in the center of the wing in an orientation perpendicular to the wing span, and the living hinge divides the wing into two wing portions so that the wing may be formed from the container by tearing the container along the tear line and rotating the wing about the living hinge to an extended position. In the extended position, the wing portions on either side of the living hinge extend in generally opposing directions with a V-shaped midregion being formed in the wing by that portion of the wing taken from the sides of the compartments and the living hinge. The wing includes a leading edge that extends across the flat bottom of the lower compartment, extends over a rounded corner at the intersection of the bottom and two sides of the lower compartment, extends along a rounded edge formed at the intersection of two sides of the lower compartment, extends across the living hinge, extends along a rounded edge formed at an intersection of two sides of the upper compartment, extends across a rounded corner formed at the intersection of two sides and the top of the upper compartment, and extends across the flat top of the upper compartment so that the leading edge of the wing is curled downwardly along and adjacent to the V-shaped midregion in the wing to form a gull-wing shape.

In accordance with another aspect of the present invention, the wing is positioned on the above described container with the leading edge of the wing disposed along a curled edge of the container between the top and an upright side and between the bottom and an upright side. In this construction, the wing will have a downwardly curled leading edge to give the wing aerodynamic lift.

BRIEF DESCRIPTION OF THE DRAWINGS

The present invention may best be understood by reference to the following Detail Description when considered in conjunction with the following drawings in which.

DETAIL DESCRIPTION

Figure 1:
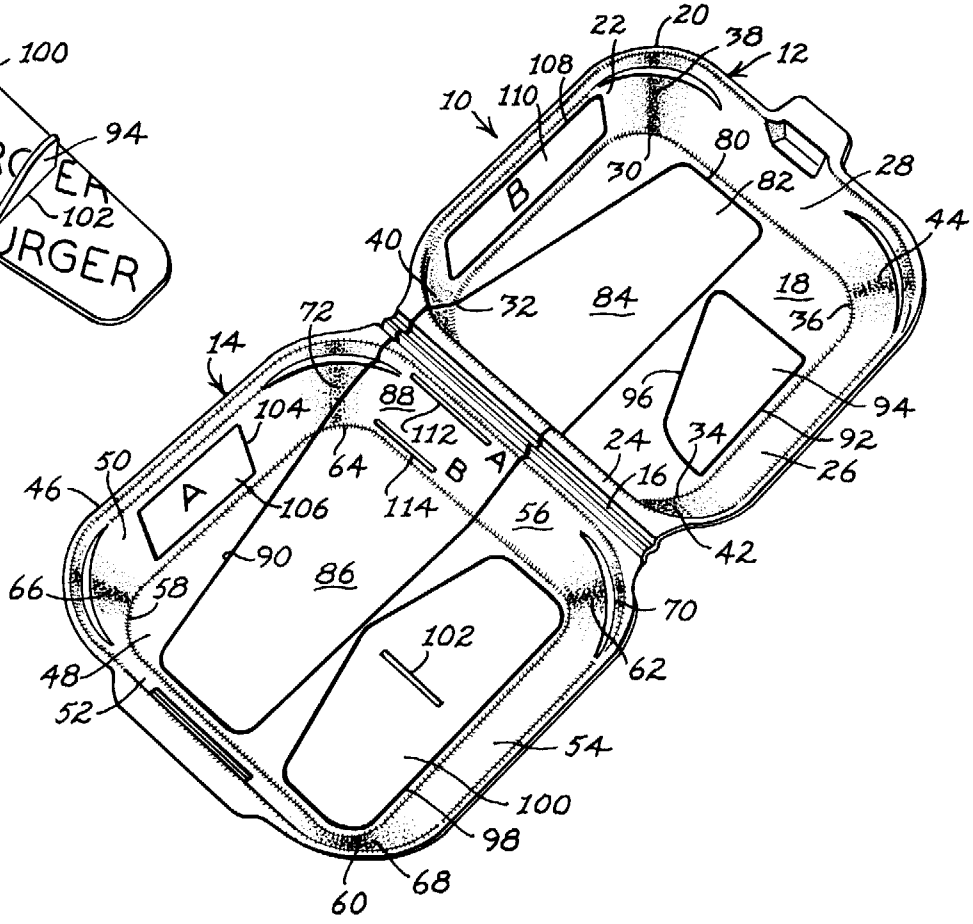
FIG. 1 is a top view of the styrofoam hamburger container having tear lines formed thereon in the shape of wing structures.

Referring now to the drawings in which like reference characters designate like or corresponding parts throughout the several views, there is shown in FIG. 1 a food container 10 embodying the present invention. The food container 10 includes an upper compartment 12 and a lower compartment 14 which are pivotally connected together by a living hinge 16. In FIG. 1, the container 10 is shown in an open position with compartments 12 and 14 disposed in a side-by-side relationship. The upper compartment 12 may be rotated about the living hinge 16 to a position above the lower compartment 14 to form a closed container. This latter position will hereinafter be referred to as the closed position.

The upper compartment 12 has a closed flat top 18, an open bottom 20 and four generally upright sides 22, 24, 26, and 28 that are inclined inwardly from the open bottom 20 to the flat top 18 so that the upper compartment 12 has a truncated quadrangular pyramid shape. Rounded corners 30, 32, 34, and 36 are formed at the intersection of the upright sides 22, 24, 26, and 28 and the flat top 18, and rounded edges 38, 40, 42, and 44 are formed at the intersections of the upright sides 22, 24, 26, and 28.

The lower compartment 14 is substantially similar to the upper compartment 12. However, the lower compartment 14 has an open top 46 and a flat bottom 48. The open top 46 is configured to mate with the open bottom 20 of the upper container 12 to form a closed container 10. The lower compartment 14 includes four generally upright sides 50, 52, 54, and 56 with rounded edges 66, 68, 70, and 72 being formed at the intersections of the upright sides. Rounded corners 58, 60, 62, and 64 are formed at the intersections of the upright sides 50, 52, 54, and 56 and the flat bottom 48.

To the extent described above, the container 10 is a conventional container for holding hamburgers and the like. This type of container is often used in fast food restaurants for temporarily storing food and maintaining it in a hot, moist condition.

In accordance with the invention, a wing tear line 80 extends along the upper and lower compartments 12 and 14 outlining a wing 82 for a toy airplane on the container 10. The wing 82 is positioned on the container with the living hinge 16 disposed in the center of the wing in an orientation perpendicular to the wing span. The living hinge 16 divides the wing 82 into two wing portions 84 and 86 so that the wing may be formed from the container by tearing the container along the tear line 80 and rotating the wing 82 about the living hinge 16 to the extended position as shown in FIG. 1. In the extended position, the wing portions 84 and 86 on either side of the living hinge 16 extend in generally opposing directions with a V-shaped midregion 88 being formed in the wing 82 by that portion of the wing taken from the sides 24 and 56 and the living hinge 16. The wing 82 has a leading edge 90 that extends across the flat bottom 48, extends over a rounded corner 64, extends along a rounded edge 72, extends across the living hinge 16, extends up the rounded edge 40, extends across the rounded corner 32, and extends along the flat top 18. In this construction, the leading edge 90 of the wing 82 is curled downwardly along and adjacent to the V-shaped midregion 88 to form a gull-wing shape.

A rudder tear line 92 is formed on the flat top 18 of the upper compartment 12 in the shape of a rudder 94. The rudder 94 has a somewhat truncated triangular shape with a leading edge 96 that is inclined rearwardly from the base to the top of the rudder.

An elevator tear line 98 is formed in the flat bottom 48 of the lower compartment 14 to outline an elevator wing 100 thereon. The elevator wing 100 includes an elevator slit 102 formed in the center of the elevator wing and perpendicular to the wing span thereof.

A tab tear line 104 outlines an elongate rectangular tab 106 on the side 50 of the lower compartment 14, and a brace tear line 108 outlines a generally rectangular elongate brace 110 on side 22 of the upper compartment 12. A letter "A" is imprinted on the tab 106 and a letter "B" is imprinted on the brace 110 for identification purposes.

Tab slits 112 are formed on either side of the living hinge 16 in the compartment sides 56 and 24. The tab slits are located adjacent to the living hinge 16 and are dimensioned to receive the ends of the tab 106. Brace slits 114 are also formed on either side of the living hinge 16 in the compartment sides 56 and 24. The brace slits 114 are formed near the top of the V-shaped midregion 88 of the wing 82 and are dimensioned to receive the ends of the brace 110.

The tab slit 112 is identified on the container 10 by the letter "A" and corresponds to the letter "A" shown on the tab 106. Thus, the letter "A" identifies the slits into which the tab 106 is intended to be inserted. The slits 112 have a length in excess of the width of the tab 106 so that the tab 106 may be moved forwardly and rearwardly in the slits. As will hereinafter be described in greater detail, the tab 106 is used to mount the wing 82 on a fuselage. By moving the tab 106 within the slits 112, the position of the wing 82 on a fuselage can be adjusted.

The slits 114 are identified by a letter "B" identifies the slit to which the brace 110 is intended to be inserted.

The tear lines formed in the container 10, namely the wing tear line 80, the rudder tear line 92, the elevator wing tear line 98, the tab tear line 104, and the brace tear line 108 may be formed in a number of ways. Such tear lines may be formed by perforating, by scoring, by crimping or by any other conventional method of weakening planar material along a tear line. It is important that the container 10 be weakened along the tear line to enable the various airplane components to be easily torn from the container, but it is also important that the tear lines do not interfere with the usefulness of the container 10. Thus, the tear lines should remain sufficiently strong to prevent inadvertent breakage of the container 10 along the tear lines while the container is being used as a container for food and the like.

The tear lines should be made by a process such as tearing or scoring when it is desired to use the container 10 as a liquid or vapor tight container. However, when it is not important that the container 10 retain liquids, the container may be perforated using a series of holes to form the tear lines. Perforation could also include crimping between the series of holes to further weaken the container 10 along the tear lines to facilitate removal of the airplane parts therefrom.

The slits formed in the container 10, namely slits 102, 112, and 114 may be completely formed in the container 10 when it is not necessary for the container to retain liquids. However, if it is desired that the container retain liquids and vapors, the slits may be formed by scored or crimped tear lines as previously described. In such case, the slit would be punched out or torn open during the construction of the airplane.

Figure 2:
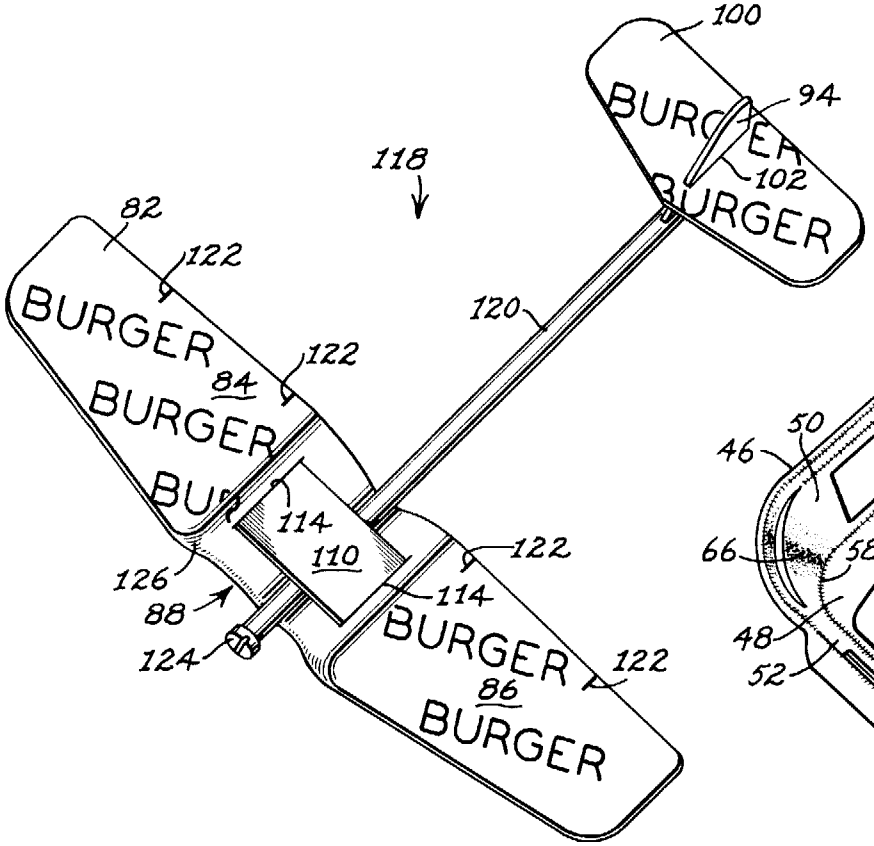
FIG. 2 is a top view of a toy glider airplane basically constructed from a hamburger food container and a straw.

The toy airplane 118 as shown in FIG. 2 is constructed from a straw 120 and the components taken from the food container 10. The wing 82 is torn from the container 10 and mounted on the forward end of the straw 120 with the straw positioned within the V-shaped midregion 88 adjacent to the living hinge 16. The brace 110 is torn from the container 10 and inserted through the slits 114 to form, in conjunction with the V-shaped midregion 88 a triangular wing structure that resists deformation during loading on the wing 82.

Two aileron slits 122 are formed on each wing portion 84 and 86 to form ailerons on the trailing edges of the wing portions. The trailing edge of the wing 82 may be bent upwardly or downwardly between the aileron slits 122 to control the glide flight of the airplane 118 in the manner of conventional ailerons.

The rudder 94 is mounted on the rearward end of the straw 120, and the elevator wing 100 is mounted on the rudder 94. The top of the rudder 94 is inserted through the elevator wing slit 102, and the elevator wing 100 is forced downwardly to jam the leading and trailing edges of the rudder 94 against the forward and rearward ends of the slit 102. Thus, the resiliency of the rudder 94 and the elevator wing 100 operate one against the other to jam the elevator wing 100 firmly on the rudder 94. A screw 124 is threadedly secured in the forward end of the straw 120 and functions as a weight to improve the flight of the toy glider airplane 118. It will be understood that any type of weight secured in the forward end of the straw 120 will be sufficient to balance the airplane 118 and improve its glide flight.

Also, in FIG. 2 it will be appreciated that the leading edge of the wing 82 along and adjacent to the V-shaped midregion 88 is curled downwardly. This downward curl in combination with the V-shape creates a gull-wing resembling the wing of a seagull. Through testing, it has been determined that the gull-shaped wing 82 provides efficient and stable gliding for the airplane 118.

Figure 3:
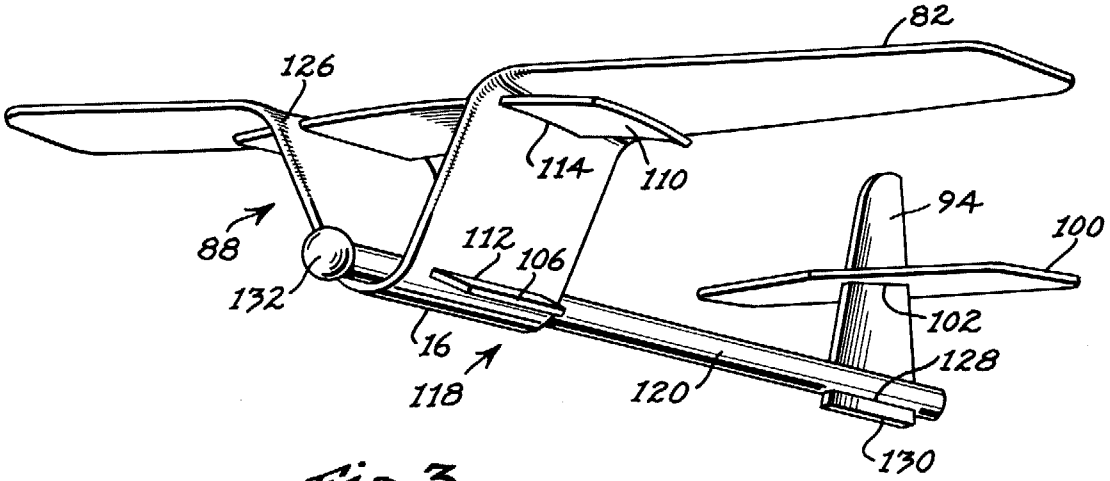
FIG. 3 is an underside view of the toy glider airplane.

In FIG. 3, the toy glider airplane 118 is shown in an underside positioned within the V-shaped midregion 188 adjacent to the living hinge 16. The brace 110 is torn from the container 10 and inserted through the slits 114 to form, in conjunction with the V-shaped midregion 88 a triangular wing structure that resists deformation during loading on the wing 82.

Two aileron slits 122 are formed on each wing portion 84 and 86 to form ailerons on the trailing edges of the wing portions. The trailing edge of the wing 82 may be bent upwardly or downwardly between the aileron slits 122 to control the glide flight of the airplane 118 in the manner of conventional ailerons.

The rudder 94 is mounted on the rearward end of the straw 120, and the elevator wing 100 is mounted on the rudder 94. The top of the rudder 94 is inserted through the elevator wing slit 102, and the elevator wing 100 is forced downwardly to jam the leading and trailing edges of the rudder 94 against the forward and rearward ends of the slit 102. Thus, the resiliency of the rudder 94 and the elevator wing 100 operate one against the other to jam the elevator wing 90 firmly on the rudder 94. A screw 24 is threadedly secured in the forward end of the straw 120 and functions as a weight to improve the flight of the toy glider airplane 118. It will be understood that any type of weight secured in the forward end of the straw 120 will be sufficient to balance the airplane 118 and improve its glide flight.

Also, in FIG. 2 it will be appreciated that the leading edge of the wing 82 along and adjacent to the V-shaped midregion 88 is curled downwardly. This downward curl in combination with the V-shape creates a gull-wing to the wing of a seagull. Through testing, it has been determined that the gull-shaped wing 82 provides efficient and stable gliding for the airplane 118.

In FIG. 3, the toy glider airplane 118 is shown in an underside perspective view to further illustrate the construction of the airplane. The wing 82 is mounted on the straw 120 by first forming slits in the forward end of the straw 120. The straw is then positioned within the V-shaped midregion 88 adjacent to the living hinge 16. The slits in the forward end of the straw 120 are aligned with the tab slits 112, and the tab 106 is then inserted through both the tab slits 112 and the slits in the straw 120 to secure the wing 82 to the straw. It will be recalled that the tab slits 112 have a length exceeding the width of the tab 106 so that the position of the wing 82 may be adjusted relative to the straw 120 by moving the tab 106 within the slits 112. It will be appreciated that the wing position could be further adjusted by making the slits in the forward end of the straw 120 also greater in length than the width of the tab 106. Then, the tab 106 could be moved forwardly and rearwardly along the slits in the straw. To fix the position of the wing 82 relative to the straw 120, the straw slits and the tab slits 112 should be constructed having a length equal to the width of the tab 106.

In the preferred embodiment, the length of the slits in the forward end of the straw 120 is just slightly greater than the width of the tab 106 to provide a tight fit between the tab and the slits in the straw. To insure that the tab 106 will not be inadvertently removed from its proper position on the airplane 118, the tab 106 is dimensioned to extend approximately one-quarter of an inch beyond each tab slit 112.

FIG. 3 shows the triangular wing structure formed by the V-shaped midregion 88 and the brace 110. When wing loading occurs, the wing 82 would tend to rotate or fold about the living hinge 16. The brace 110 extending across the top of the V-shaped midregion 88 will resist deformation of the wing about the living hinge 16. Upward forces along the wing 82 such as experienced during flight will cause compression loading on the brace 110, and downward forces along the wing 82 will cause tension loading on the brace 110. In either event, deformation of the wing 82 is resisted by the brace 110. To function properly, there must be a tight fit between the brace slits 114 and the brace 110. Thus, the brace slits 114 have a width approximately equal to or slightly smaller than the thickness of the brace 110. It is necessary to force the brace 110 through the brace slits 114 so that the brace is resiliently held within the slits 114. The brace 110 is dimensioned to have a length sufficient to allow each end of the brace to extend approximately one-half inch beyond the slits 114 to insure that the brace 110 is not inadvertently removed from its proper position on the airplane 118 during use.

Referring now to the rearward end of the toy airplane 118, the mounting of the rudder 94 on the straw 120 is clearly shown in FIG. 3. A pair of slits 128 are formed in the rearward end of the straw 120 in a plane perpendicular to the wing span of the wing 82. The length of the tail slits 128 is less than the length of the base 130 of the rudder 94. The rudder 94 has a somewhat truncated triangular shape with the top of the rudder being smaller in width than the base 130 of the rudder. Thus, the top of the rudder 94 is inserted from the bottom of the straw 120 through the tail slits 128, and the rudder is forced upwardly until the leading and trailing edges of the rudder are jammed against the forward and rearward ends of the tail slits 128. In this manner, the resiliency of the styrofoam rudder 94 and the plastic straw 120 holds the rudder firmly in place within the tail slits 128.

Referring now to the forward end of the straw 120, it will be noted that a rounded rubber weight 132 is secured therein. The weight 132 is made of soft rubber and has a rounded shape to provide a soft blunt tip on the airplane 118. A projection extends from the rubber weight 132 and is resilienty secured within the straw 120 to mount the weight 132 in the straw. The weight 132 may be constructed entirely of soft rubber, or may be a rubber cap on the head of a screw such as screw 124 shown in FIG. 2. In either construction, the function of the weight 132 is to provide the necessary weight in the forward end of the airplane 118 for balance and to provide a soft tip on the airplane, thereby, preventing injury when the airplane strikes an object or a person.

Figure 4:
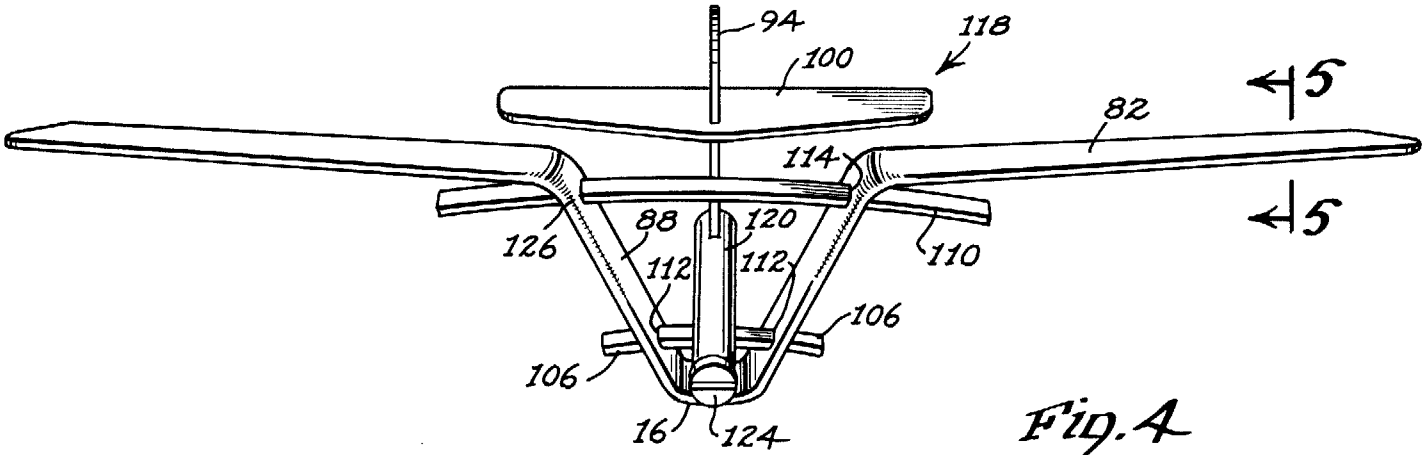
FIG. 4 is a front view of the toy glider airplane.

Referring now to FIG. 4, there is shown a front isometric view of the airplane 118. In this view, the structure of the wing 82 including its bracing and attaching structure is clearly shown. The tab 106 extends through the straw 120 and through the tab slits 12 to secure the straw 120 to the wing 82. The brace 110 extends across the top of the V-shaped midregion 88 through the brace slits 114 to form a triangular wing structure for resisting deformation under wing loading. It will be appreciated that this structure is simple in design and easy to construct, and yet provides an efficient and stable glider airplane.

In the embodiments described with reference to FIGS. 1–4, only the midregion 88 has downwardly curved leading edges. Referring to FIG. 1, it will be appreciated that the leading edge of the wing 82 may be cut along the curved edge between the bottom 48 and the upright side 50 and along the curved edge between the top 18 and the upright side 22. In such case the entire leading edge of the wing 82 would be curved downwardly as shown in the cross sectional view of the wing 82 in FIG. 5.

Figure 5:
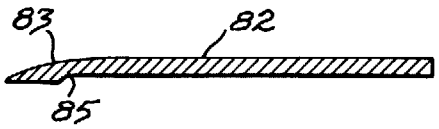
FIG. 5 is a cross sectional view of a wing having its leading edge cut from a curved portion of a sandwich container so that the wing has true aerodynamic lift.

In FIG. 5, the wing 82 has been cut from the container 10 as described above to have a down turned leading edge 83. The particular cut through container 10 used to form the wing 82 as shown in FIG. 5 has left a notch 85 on the underside of the wing to creat aerodynamic drag. If desired, the cut through the container may be positioned to eliminate the notch 85 and reduce overall wing drag. In the construction shown in FIG. 5, the wing 82, with or without notch 85, has aerodynamic lift by virtue of its shape.

Figure 6:
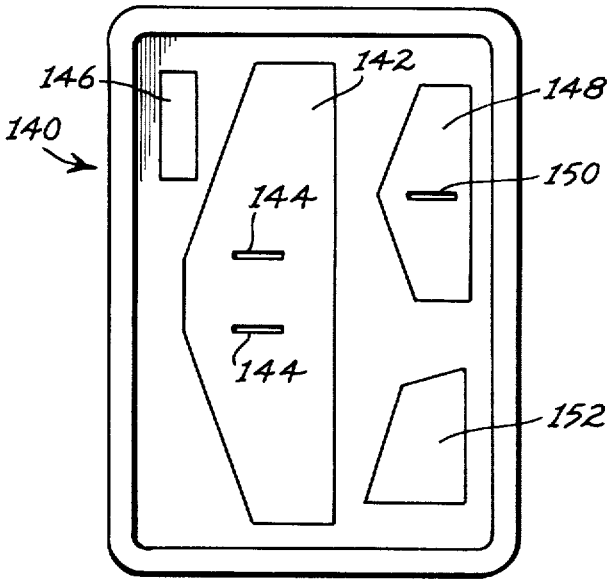
FIG. 6 is a top view of a portion of a container having tear lines formed thereon in the shape of wing structures.

Referring now to FIG. 6, there is shown an alternate embodiment of the present invention in which a styrofoam container 140 has a plurality of tear lines formed along the container in the shape of toy airplane structures. Specifically, the tear lines outline a main wing 142 having a pair of tab slits 144 formed therein. The tear lines also outline an elevator wing 148, a rudder 152, and a tab 146. The elevator wing includes an elevator slit 150 formed in the center of the elevator wing in an orientation perpendicular to the elevator wing span. As in the first embodiment, the elevator wing slit 150 is dimensioned for mounting the elevator wing 148 on the rudder 152 as previously described. The tab slits 144 are dimensioned to snugly receive the ends of the tab 146.

Referring now to FIG. 2, there is shown a front view of an airplane 154 that is constructed from the components shown in FIG. 6. The main wing 142 is attached to a straw 120 in a fashion as shown in FIGS. 2–4. Slits are formed in the forward end of the straw 120, and the straw is positioned in the center of the wing 142 with the straw slits positioned between the tab slits 144. The tab 146 is then inserted through the slits in the straw 120 and through the tab slits 144 to secure the wing 142 to the straw.

The rudder 152 is mounted on the rearward end of the straw 120, and the elevator wing 148 is mounted on the rudder 152 in the same manner as described in conjunction with FIG. 3 and the first embodiment of the present invention.

Figure 8:
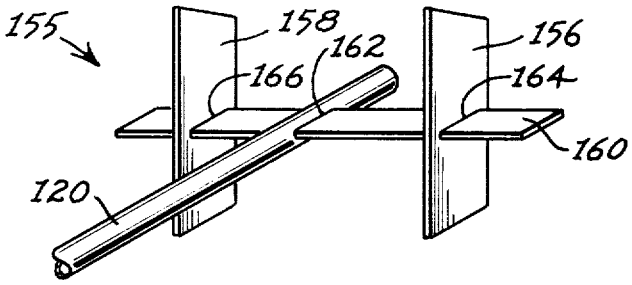
FIG. 8 is a perspective view of an alternate tail section for a toy airplane that may be constructed from a straw and food container material.

Referring now the FIG. 8, and alternate rear tail section 155 is shown for being constructed from a styrofoam food container. The tail section 155 includes two upright rudders 156 and 158 mounted on a generally horizontal elevator wing 160. The elevator wing 160 is inserted through tail slits 162 in the rearward end of the straw 120 to mount the elevator wing on the straw. The rudders 156 and 158 are mounted on the elevator wing 160 by inserting the ends of the elevator wing 160 through the rudder slits 164 and 166.

Figure 7:
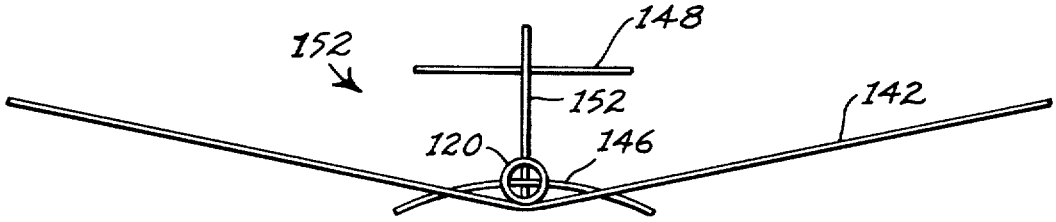
FIG. 7 is a front view of a toy airplane constructed from a straw and the container shown in FIG. 6.

The airplane 154 shown in FIGS. 6 and 7, and the tial section 155 shown in FIG. 8 is intended to exemplify different embodiments of the present invention. Although particular embodiments of the present invention have been described in the foregoing Detailed Description, it will be appreciated that the invention is capable of numerous rearrangements, modifications and substitutions of parts without departing from the spirit of the invention. The embodiments shown in FIGS. 5–8 are considered modifications of the embodiment of the invention described in conjunction with FIGS. 1–4.

I claim:

1. A toy glider airplane for being constructed from the generally planar material comprising:

a drinking straw having a forward end and a rearward end;

a plurality of wing structures constructed from the generally planar material of the container;

first means for mounting at least one of said wing structures on the forward end of said straw to form a forward main wing of the toy glider airplane for providing lift during flight;

second means for mounting at least one of said wing structures on the rearward end of said straw for controlling the orientation of the toy airplane during flight;

a forward slit formed in the forward end of said straw;

a pair of opposing tab slits formed in said forward main wing on either side of and equidistantly from said straw; and a tab inserted through said forward slit and said tab slits to secure said wing structure to said straw to form the forward main wing on the airplane.

2. A toy glider airplane for being constructed at least partially from a container formed of generally planar material comprising:

a drinking straw having a forward end and a rearward end;

a plurality of wing structures constructed from the generally planar material of the container;

first means for mounting at least one of said wing structures on the forward end of said straw to form a forward main wing of the toy glider airplane for providing lift during flight;

second means for mounting at least one of said wing structures on the rearward end of said straw for controlling the orientation of the toy airplane during flight; and a tail slit formed through the rearward end of said straw and with at least one of said wing structures passing through said tail slit to form at least one flight control tail wing for controlling the orientation of the toy airplane during flight.

3. A toy glider airplane for being constructed from a container formed of generally planar material, comprising:

a wing contructed of the generally planar material of the container, said wing having a V-shaped midregion with two spaced apart upper midregion edges and two wing portions extending outwardly from said upper midregion edges;

a substantially rigid fuselage having forward and rearward ends;

means for attaching the center of the V-shaped midregion of said wing adjacent to the forward end of said fuselage;

a planar brace member constructed from the planar material attached to said wing and extending across the top of the V-shaped midregion between said spaced apart upper midregion edges to form a triangular load bearing wing structure, said planar brace member being operable to reinforce the V-shaped midregion of said wing to prevent deformation thereof under loading on the wing portions before and during flight of the airplane; and flight control means constructed of the generally planar material and being mounted adjacent to the rearward end of said fuselage for controlling the orientation of the airplane during flight.

4. The airplane of claim 3 wherein said wing has leading edge that curls downwardly along and immediately adjacent to the V-shaped midregion to form a gull-wing.

5. The airplane of claim 3 further comprising a plurality of slits formed in and perpendicular to the trailing edge of each of the two wing portions to form at least one aileron on each wing portion.

6. The airplane of claim 3 wherein said wing includes a leading edge having a downward curl to provide aerodynamic lift for the wing.

7. The airplane of claim 3 wherein said wing and said flight control means are constructed of planar styrofoam material from the container.

8. The airplane of claim 3 wherein said flight control means comprises:

a rudder formed of the planar materials;

means for mounting said rudder adjacent the rearward end of said fuselage in an orientation generally perpendicular to said wing;

an elevator formed of the planar material; and means for mounting said elevator adjacent the rearward end of said fuselage in an orientation generally perpendicular to said rudder and generally parallel to said wing.

9. The airplane of claim 3 wherein said fuselage is a drinking straw.

10. The airplane of claim 9 further comprising a weight mounted in the forward end of said straw.

11. The airplane of claim 10 wherein said said weight is wedge-shaped for being forced into the forward end of said straw to be held therein by the elasticity of said straw.

12. The airplane of claim 10 wherein said weight is a screw that is threadedly secured in the forward end of said straw.

13. The airplane of claim 10 wherein said weight has a blunt forward end formed of soft rubber so that said weight will absorb shock to prevent injury when the airplane strikes an object during flight.

14. The airplane of claim 9 wherein said flight control means comprises:

a rudder formed of the planar material and having a truncated somewhat triangular shape with leading and trailing edges and with the base of said rudder being at the base of the truncated triangular shape;

tail slits formed through the rearward end of said straw and having a length of less than the length of the base of said rudder, said tail slits being formed in a plane generally perpendicular to said wing;

said rudder being inserted through said tail slits with the leading and trailing edges of said rudder being jammed against the forward and rearward ends of one of said tail slits to secure said rudder on said straw;

an elevator wing constructed on the planar material;

an elevator slit formed in the center of said elevator wing oriented perpendicularly with respect to the span of said elevator wing, said elevator slit having a length less than the length of the base of said rudder; and said rudder being inserted through said elevator slit and being jammed against the forward and rearward ends of said elevator slit to secure said elevator wing on said rudder.

15. The airplane of claim 9 wherein said means for attaching comprises:

a forward fuselage slit formed in the forward end of said straw;

two opposing tab slits forward in the V-shaped midregion of said wing with one of said tab slits formed on either side of and adjacent to the center of the V-shaped midregion;

said straw being positioned within the V-shaped midregion and adjacent to the center thereof with said forward fuselage slit being aligned with said two opposing tab slits in the V-shaped midregion; and a planar tab inserted through said forward fuselage slit in said straw and said two opposing tab slits in the V-shaped midregion to secure said straw to said wing.

16. The airplane of claim 15 wherein the length of said forward fuselage slit in said straw is greater than the width of said planar tab so that the position of said wing relative to said straw is adjustable by sliding said planar tab forwardly and rearwardly in said forward fuselage slit.

17. The airplane of claim 15 wherein the length of said two opposing tab slits is greater than the width of said planar tab so that the position of said wing relative to said straw is adjustable by sliding said planar tab forwardly and rearwardly within said two opposing tab slits.

18. A method for constructing a toy airplane from a fuselage and a container having top and bottom compartments attached together by a living hinge so that the top and bottom compartments may be rotated relative to each other about the living hinge, said method comprising the steps of:

forming a tear line on the container in the shape of a wing oriented generally perpendicularly to the living hinge with the living hinge in the center of the wing and perpendicular to the span of the wing;

tearing the food container along the tear line;

removing the wing from the food container;

attaching the wing to the fuselage to form a main forward wing of the toy airplane; and mounting flight control structure on the fuselage to control the orientation of the airplane during flight.

19. The method of claim 1 wherein said step of forming a tear line comprises perforating the container.

20. The method of claim 1 wherein said step of forming a tear line comprises scoring the container.

21. The airplane of claim 18 wherein the step of mounting flight control structure comprises:

forming tear lines on the container in the shape of a rudder and in the shape of an elevator wing for a toy airplane;

tearing the container along the tear lines to remove the rudder and elevator wing from the container; and attaching the rudder and elevator wing to the rearward end of the fuselage to control the orientation of the airplane during flight.

22. A method of constructing a toy airplane from a straw and a container having a top and bottom compartment attached together along one edge thereof by a living hinge so that the top compartments may be rotated relative to the bottom compartment about the living hinge, said method comprising the steps of:

forming a wing tear line on the container in the shape of a wing oriented generally perpendicularly to the living hinge with the living hinge disposed in the center of the wing;

tearing the container along the wing tear line;

removing the wing from the container;

forming a tab tear line on the container in the shape of an elongate rectangle;

forming a brace tear line on the container in the shape of an elongate rectangle;

tearing the container along the tab tear line and the brace tear line;

removing the tab and the brace from the container;

forming a forward slit through the forward end of the straw;

forming a pair of opposing tab slits in the wing on either side of the living hinge and adjacent thereto;

inserting the tab through the forward slit in the straw and through the tab slits to secure the wing to the forward end of the straw;

forming a pair of opposing brace slits in the wing, the brace slits being located on either side of the living hinge and being disposed equidistantly therefrom;

inserting the ends of the brace through the brace slits to form a triangular load bearing wing structure for resisting deformation during loading on the wing; and attaching flight control wing structure to the rearward end of the straw for controlling the orientation of the airplane during flight.

23. The method of claim 22 wherein said step of attaching flight control structure comprises:

forming a tail slit in the rearward end of the straw;

forming a rudder tear line and an elevator tear line on the container in the shape of a rudder and an elevator wing, respectively;

tearing the container along the rudder tear line and the elevator tear line;

removing the rudder and elevator wing from the container;

inserting the rudder through the tail slit formed in the rearward end of the straw;

forming an elevator slit in the center of the elevator wing, said elevator slit being oriented generally perpendicularly to the span of the elevator wing; and securing the elevator on the rudder by inserting the rudder through the elevator slit.

24. A method of constructing a toy airplane from a straw and a styrofoam container having an upper compartment with an open bottom, a closed flat top, and four generally upright sides inclined inwardly from the open bottom to the flat top so that the upper compartment has a truncated quadrangular pyramid shape, the upper compartment having rounded corners at the intersections of the upright sides and the top thereof and having rounded edges at the intersections of the upright sides thereof, the styrofoam container further having a lower compartment with an open top, a closed flat bottom, and four generally upright sides inclined inwardly from the open top to the flat bottom so that the lower compartment has a truncated quadrangular pyramid shape, the top of the lower compartment being constructed to mate with the bottom of the upper compartment to form a closed container, the lower compartment having rounded corners at the intersections of the upright sides and the bottom thereof and having rounded edges at the intersection of the upright sides thereof, the food container including a living hinge formed between a lower edge of an upright side of the upper compartment and an upper edge of an upright side of the lower compartment so that said upper and lower compartments are rotatable about the living hinge between a closed position in which the upper compartment is disposed above the lower compartment to form a closed food container and an open position in which the upper and lower compartments are disposed in a side-by-side relationship, said method comprising the steps of:

forming a wing tear line along the upper and lower compartments outlining a wing of a toy airplane with the wing being positioned on the food container to dispose the living hinge in the center of the wing and in an orientation perpendicular to the wing span thereof, the wing being divided into two wing portions by the living hinge, the wing including a leading edge that extends across the flat bottom of the lower compartment, extends over a rounded corner at an intersection of the bottom and two sides of the lower compartment, extends along a rounded edge at the intersection of two sides of the lower compartment, extends across the living hinge, extends along a rounded edge at an intersection of two sides of the upper compartment, extends across a rounded corner formed at the intersection of two sides and the top of the upper compartment, and extends across the flat top of the upper compartment so that the leading edge of the wing is curled downwardly along a center portion of the wing formed from the rounded corners and edges to form a gull-wing;

tearing the food container along the wing tear line and removing the wing from the container;

rotating the wing about the living hinge to an extended position in which the wing portions on either side of the living hinge extend in generally opposing directions with a V-shaped midregion being formed in the wing by that portion of the wing taken from the sides of the upper and lower compartments and from the living hinge;

attaching the wing to the forward end of the straw with the living hinge portion of the wing adjacent to the straw; and attaching flight control wings to the rearward end of the straw.

25. The method of claim 24 further comprising:

forming a rudder tear line and an elevator tear line in the container in the shape of a rudder and an elevator wing, respectively;

tearing the container along the rudder tear line and the elevator tear line;

removing the rudder and elevator wing from the food container;

forming a tail slit through the rearward end of the straw;

securing the rudder to the rearward end of the straw by inserting the rudder through the tail slit;

forming an elevator slit in the center of the elevator wing in an orientation perpendicular to the span of the elevator wing; and securing the elevator wing to the rudder by inserting the rudder through the elevator slit.

26. The method of claim 24 further comprising:

forming a tab tear line and a brace tear line on the food container, each in the shape of an elongate rectangle;

tearing the food container along the tab tear line and the brace tear line to remove a tab and a brace from the container;

forming a forward slit in the forward end of the straw;

forming two opposing tab slits in the wing on either side of the living hinge and adjacent thereto;

positioning the straw in the center of the V-shaped midregion of the wing;

aligning the wing slit with the tab slits;

inserting the tab through the tab slits and the wing slit to secure the wing to the forward end of the straw;

forming a pair of brace slits in the wing on either side of the living hinge and spaced equidistantly therefrom; and inserting the ends of the brace into the brace slits to form a triangular load bearing wing structure to resist deformation of the wing during wing loading.

27. The method of claim 24 further comprising:

forming a rudder tear line and an elevator tear line in the container in the shape of a rudder and an elevator wing, respectively;

tearing the container along the rudder tear line and the elevator tear line;

removing the rudder and elevator wing from the food container;

forming a tail slit through the rearward end of the straw;

securing the rudder to the rearward end of the straw by inserting the rudder through the tail slit;

forming an elevator slit in the center of the elevator wing in an orientation perpendicular to the span of the elevator wing;

securing the elevator wing to the rudder by inserting the rudder through the elevator slit;

forming a tab tear line and a brace tear line on the food container, each in the shape of an elongate rectangle;

tearing the food container along the tab tear line and the brace tear line to remove a tab and a brace from the container;

forming a forward slit in the forward end of the straw;

forming two opposing tab slits in the wing on either side of the living hinge and adjacent thereto;

positioning the straw in the center of the V-shaped midregion of the wing;

aligning the wing slit with the tab slits;

inserting the tab through the tab slits and the wing slit to secure the wing to the forward end of the straw;

forming a pair of brace slits in the wing on either side of the living hinge and spaced equidistantly therefrom; and inserting the ends of the brace into the brace slits to form a triangular load bearing wing structure to resist deformation of the wing during wing loading.

28. A container for containing food and the like and for use in constructing a toy airplane, comprising the combination of:

an upper compartment having a boxlike shape with four generally upright sides, a top and an open bottom;

a lower compartment having a boxlike shape with four generally upright sides, a bottom and an open top, the top of said lower compartment mating with the bottom of said upper compartment;

a tear line formed in said compartment in the shape of at least one wing, said compartment being weakened along said tear line to facilitate tearing said wing from the compartment;

a living hinge formed between the lower edge of an upright side of said upper compartment and the upper edge of an upright side of said lower compartment so that said upper and lower compartments are rotatable between a closed position in which the upper compartment is disposed above the lower compartment and an open position in which said upper and lower compartments are disposed in a side by side relationship; and said tear line being formed in the shape of a wing extending perpendicularly across said living hinge; and said living hinge being disposed in the center of said wing with two wing portions extending away from said living hinge so that the wing is removable from the food container by a tearing action and the wing portions are rotatable about the living hinge to an extended position in which the wing portions extend in generally opposing directions.

29. The container of claim 28 further comprising a rudder tear line and an elevator tear line formed on the container in the shape of a rudder and an elevator wing, respectively, for a toy airplane so that the container may be torn along the rudder tear line and the elevator tear line to remove a rudder and an elevator wing therefrom for use in the toy airplane.

30. In a container having an upper compartment constructed of generally planar material with an open bottom, a closed flat top, and four generally upright sides inclined inwardly from the open bottom to the flat top so that the upper compartment has a truncated quadrangular pyramid shape, the upper compartment having rounded corners at the intersection of the upright sides and the top thereof, and having rounded edges at the intersections of the generally upright sides thereof, the container further having a lower compartment constructed of generally planar material with an open top, a closed flat bottom and four generally upright sides inclined inwardly from the open top to the closed flat bottom so that the lower compartment has a truncated pyramid shape, the open top of the lower compartment being constructed to mate with the open bottom of said upper compartment to form a closed container, the lower compartment having rounded corners at the intersections of the sides and the bottom thereof and having rounded edges at the intersections of the upright sides thereof, the container further having a living hinge formed between the lower edge of an upright side of the upper compartment and the upper edge of an upright side of the lower compartment so that said compartments are rotatable between a closed position in which the upper compartment is disposed above the lower compartment to form a closed container and an open position in which said upper and lower compartments are disposed in a side-by-side relationship, the improvement comprising:

a wing tear line extending along along said upper and lower compartments and outlining a wing for a toy airplane on the container, said wing being positioned on the container with the living hinge disposed in the center of the wing in an orientation perpendicular to the wing span, the living hinge dividing said wing into two wing portions so that said wing may be formed from the container by tearing the container along the tear line and rotating the wing about said living hinge to an extended position in which the wing portions on either side of the living hinge extend in generally opposing directions with a V-shaped midregion being formed in said wing by that portion of the wing taken from the sides of the compartments and the living hinge; and said wing having a leading edge that extends across the flat bottom of the lower compartment, extends over a rounded corner at an intersection of the bottom and two sides of the lower compartment, extends along a rounded edge formed at the intersection of two sides of said lower compartment, extends across the living hinge, extends along a rounded edge formed at an intersection of two sides of the upper compartment, extends across a rounded corner formed at the intersection of two sides and the top of said upper compartment, and extends across the flat top of the upper compartment so that the leading edge of the wing is curled downwardly along and adjacent to the V-shaped midregion in said wing to form gull-wing shape.

31. The improvement of claim 30 further comprises:

a rudder tear line formed on the container in the shape of a rudder for use in a toy airplane; and an elevator tear line formed on the compartment in the shape of an elevator wing for use in a toy airplane.

32. The food container of claim 30 further comprising:

a tab tear line formed in the shape of an elongate rectangular tab; and a pair of opposing tab slits formed in said wing on either side of said living hinge and adjacent thereto, said tab slits being dimensioned to receive the ends of said tab so that said tab may be inserted into said tab slits for use in securing said wing to a fuselage of the toy airplane.

33. The improvement of claim 30 further comprising:

a base tear line formed on the container in the shape of an elongate rectangle; and brace slits formed in said wing on either side of the living hinge at a predetermined distance therefrom, said brace slits being oriented perpendicular to the wing span and being dimensioned to receive the ends of said brace, so that said brace may be inserted into said brace slits to form a triangular wing structure for resisting deformation during wing loading.

* * * * *